US011852144B2

(12) United States Patent
Hu et al.

(10) Patent No.: US 11,852,144 B2
(45) Date of Patent: Dec. 26, 2023

(54) SCROLL COMPRESSOR

(71) Applicant: Danfoss (Tianjin) Ltd., Tianjin (CN)

(72) Inventors: Qian Hu, Nordborg (DK); Gang Yao, Nordborg (DK); Xueyou Zhou, Nordborg (DK); Alain Picavet, Nordborg (DK); Arnaud Daussin, Nordborg (DK); Rémi Bou Dargham, Nordborg (DK); David Genevois, Nordborg (DK)

(73) Assignee: Danfoss (Tianjin) Ltd., Tianjin (CN)

( * ) Notice: Subject to any disclaimer, the term of this patent is extended or adjusted under 35 U.S.C. 154(b) by 8 days.

(21) Appl. No.: 17/900,411

(22) Filed: Aug. 31, 2022

(65) Prior Publication Data

US 2023/0103461 A1 Apr. 6, 2023

(30) Foreign Application Priority Data

Sep. 3, 2021 (CN) ..... 202111036491.1

(51) Int. Cl.
*F04C 29/02* (2006.01)
*F04C 18/02* (2006.01)
*F04C 29/00* (2006.01)

(52) U.S. Cl.
CPC ..... *F04C 29/028* (2013.01); *F04C 18/0215* (2013.01); *F04C 29/005* (2013.01); (Continued)

(58) Field of Classification Search
CPC .. F04C 29/028; F04C 18/0215; F04C 29/023; F04C 2240/603; F04C 2240/807; (Continued)

(56) References Cited

U.S. PATENT DOCUMENTS 4,997,349 A * 3/1991 Richardson, Jr. ..... F04C 29/023 418/55.6
10,746,174 B2 8/2020 Daussin et al.
(Continued)

FOREIGN PATENT DOCUMENTS

CN 1766341 A 5/2006
CN 106468264 A 3/2017
(Continued)

*Primary Examiner* — Wesley G Harris
(74) *Attorney, Agent, or Firm* — McCormick, Paulding & Huber PLLC

(57) ABSTRACT

The present disclosure relates to a scroll compressor and its lubricating oil supply system. The lubricating oil supply system includes: an oil passage $P_1$ formed by a core hole extending longitudinally through the crankshaft; an oil pump, whose oil suction port is immersed in the lubricating oil in the oil pool, and the oil outlet is connected to the oil circuit $P_1$; an oil passage $P_3$ located in the gap between the upper end surface of the crankshaft and the lower surface of the orbiting scroll; an oil passage $P_4$ formed by a longitudinal hole in the crankshaft, the longitudinal hole extending downwards from the upper end surface of the crankshaft; an oil passage $P_5$ formed by a transverse hole in the crankshaft and a gap between the lower edge of the hub of the orbiting scroll and the upper surface of the upper counterweight, the transverse hole extending transversely from the outer peripheral surface of the upper end of the crankshaft to communicate with the longitudinal hole, the opening of the transverse hole on the outer peripheral surface of the upper end of the crankshaft is aligned with the gap between the lower edge of the hub and the upper surface of the upper counterweight; an oil passage $P_6$ formed by the gap between the outer peripheral surface of the hub and the upright wall of the upper counterweight, and the gap between the outer peripheral surface of the hub and the inner peripheral surface of the center hole of the housing; and an oil passage $P_2$ formed by an oil return pipe so that the lubricating oil circulates.

10 Claims, 6 Drawing Sheets

(52) U.S. Cl.
CPC ..... *F04C 29/023* (2013.01); *F04C 2240/30* (2013.01); *F04C 2240/40* (2013.01); *F04C 2240/603* (2013.01); *F04C 2240/807* (2013.01)

(58) Field of Classification Search
CPC ..... F04C 23/008; F04C 18/02; F04C 27/005; F04C 29/0057; F04C 29/02
USPC ..... 418/55.1, 55.5, 55.2, 94, 151
See application file for complete search history.

(56) References Cited

U.S. PATENT DOCUMENTS

| | | | | |
|---|---|---|---|---|
| 2007/0003424 | A1* | 1/2007 | Benco | F04C 18/0215 418/55.3 |
| 2010/0092321 | A1* | 4/2010 | Kim | F04C 29/028 418/55.6 |
| 2018/0363656 | A1* | 12/2018 | Johnson | F04C 23/008 |

FOREIGN PATENT DOCUMENTS

| | | | |
|---|---|---|---|
| CN | 108361193 | B | 8/2018 |
| CN | 208900359 | U | 5/2019 |
| CN | 210565070 | U | 5/2020 |
| CN | 211975385 | U | 11/2020 |
| JP | 2013036409 | A | 2/2013 |
| WO | 2021124500 | A1 | 6/2021 |

* cited by examiner

SCROLL COMPRESSOR

CROSS-REFERENCE TO RELATED APPLICATION

This application claims foreign priority benefits under U.S.C. § 119 from Chinese Patent Application No. 202111036491.1 filed Sep. 3, 2021, the content of which is hereby incorporated by reference in its entirety.

TECHNICAL FIELD

The disclosure relates to a scroll compressor, in particular to a lubricating oil supply system adapted for the scroll compressor.

BACKGROUND

The orbiting scroll of a scroll compressor is supported by a fixed housing in the axial direction. During the operation of the scroll compressor, the friction pair formed between the housing and the orbiting scroll continuously rubs against each other, so there is a risk of wear in the thrust surface, which may eventually lead to the reduced performance or even failure of the scroll compressor.

At present, a lubricating oil supply system of a scroll compressor on the market seldom has a design with stable oil supply and sufficient lubrication of the thrust surface, so it cannot effectively prevent the wear of the thrust surface when the scroll compressor is operating at a high speed.

SUMMARY

Technical Problem

The present disclosure has been made in order to solve the above technical problems and other potential technical problems.

Technical Solution

The general concept of the technical solution of the present disclosure is: transporting the lubricating oil in the oil pool at the bottom of the scroll compressor to the thrust surface between the housing and the orbiting scroll with the lubricating oil supply passages designed on the crankshaft in combination with a specially designed upper counterweight. By adopting such a design, the friction pair of the thrust surface can be effectively lubricated, so as to ensure the reliability of the long-term operation of the compressor. Specifically, with a special design of the line shape of the upper counterweight, the lubricating oil can reach the thrust surface of the housing through the wall surface of the upper counterweight by the action of centrifugal force. During the high-speed operation of the scroll compressor, the lubrication oil can effectively prevent the wear of the thrust surface and improve the reliability of the scroll compressor.

The present disclosure provides a scroll compressor, the scroll compressor comprises:

a shell, an oil pool for storing lubricating oil being formed at the bottom of the shell;

a scroll assembly disposed in the shell, and the scroll assembly comprising:

a fixed scroll fixed in the shell, an orbiting scroll disposed below the fixed scroll and cooperating with the fixed scroll to form a compression chamber, and a housing fixed in the shell and supporting the orbiting scroll below the orbiting scroll, thereby forming a friction pair between the lower surface of the orbiting scroll and the upper surface of the housing; and a drive assembly comprising:

an electric motor, a crankshaft, which can be driven by the electric motor to rotate, the upper end of the crankshaft being cylindrical and inserted into the center hole of the hub at the bottom of the orbiting scroll to drive the orbiting scroll to revolve, and an upper counterweight disposed at the upper end of the crankshaft and rotating with the crankshaft, the upper counterweight having an upper surface and an upright wall extending upwards from the upper surface, the upright wall being generally a part of a cylindrical body, and the hub of the orbiting scroll being inserted into the gap between the outer peripheral surface of the upper end of the crankshaft and the inner wall surface of the upright wall.

The scroll compressor further comprises a lubricating oil supply system and the lubricating oil supply system comprises:

an oil passage $P_1$ formed by a core hole extending generally longitudinally through the crankshaft;

an oil pump installed at the lower end of the crankshaft, wherein the oil suction port at the lower end of the oil pump is immersed in the lubricating oil in the oil pool, and the oil outlet at the upper end of the oil pump is connected to the oil passage $P_1$;

an oil passage $P_3$ located in the gap between the upper end surface of the crankshaft and the lower surface of the orbiting scroll;

an oil passage $P_4$ formed by a longitudinal hole in the crankshaft, the longitudinal hole extending downwards from the upper end surface of the crankshaft;

an oil passage $P_5$ formed by a transverse hole in the crankshaft and a gap between the lower edge of the hub of the orbiting scroll and the upper surface of the upper counterweight, wherein the transverse hole extending transversely from the outer peripheral surface of the upper end of the crankshaft to communicate with the longitudinal hole, the opening of the transverse hole on the outer peripheral surface of the upper end of the crankshaft is aligned with the gap between the lower edge of the hub of the orbiting scroll and the upper surface of the upper counterweight;

an oil passage $P_6$ formed by the gap between the outer peripheral surface of the hub of the orbiting scroll and the inner wall surface of the upright wall, and the gap between the outer peripheral surface of the hub of the orbiting scroll and the inner peripheral surface of the center hole of the housing; and an oil passage $P_2$ formed by an oil return pipe, the upper end opening of the oil return pipe being located at the bottom of the housing, and the lower end opening of the oil return pipe leading to the oil pool to circulate the lubricating oil along the following route:

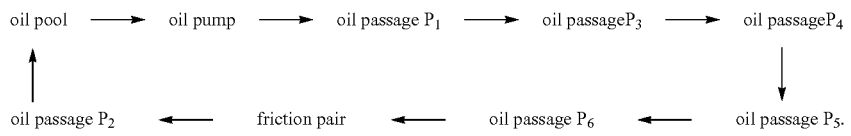

Optionally, the inner wall surface of the upright wall comprises a first arc section and a second arc section. When the driving assembly is viewed from top, the rotation center of the crankshaft, the circle center of the upper end of the crankshaft and the circle center of the first arc section are collinear, and the circle center of the upper end of the crankshaft and the circle center of the first arc section are respectively located on opposite sides of the rotation center of the crankshaft, and the second arc section are centered in the circle center of the upper end of the crankshaft. When referring to the rotation direction of the crankshaft, the first arc section is located on the upstream side of the second arc section, so that the radius $r_1$ of the first arc section, the distance $r_A$ from the upstream end of the first arc section to the rotation center of the crankshaft, the distance $r_B$ from the downstream end of the first arc section to the rotation center of the crankshaft, and the distance d from the upstream end of the second arc section to the circle center of the first arc section satisfy the following relationship: $r_1>d$ and $r_B>r_A$. The opening of the transverse hole on the outer peripheral surface of the upper end of the crankshaft is configured to face the upstream end of the first arc section.

Optionally, when the driving assembly is viewed from top, the inner wall surface of the upright wall is generally semi-arc. The rotation center $O_1$ of the crankshaft, the circle center ($O_2$) of the upper end of the crankshaft and the circle center ($O_3$) of the inner wall surface are collinear, and the circle center ($O_2$) of the upper end of the crankshaft and the circle center ($O_3$) of the inner wall surface are respectively located on opposite sides of the rotation center $O_1$ of the crankshaft, so that when referring to the rotation direction (RD) of the crankshaft, the distance $r_A$ from the upstream end point A of the inner wall surface to the rotation center $O_1$ of the crankshaft, and the distance $r_B$ from any point B located on the downstream side of the upstream end point A on the inner wall surface to the rotation center $O_1$ of the crankshaft satisfy the following relationship: in the range of $\angle AO_1B<90°$, $r_B>r_A$. The opening of the transverse hole on the outer peripheral surface of the upper end of the crankshaft is configured to face the upstream end point A of the inner wall surface.

Preferably, a chamfer is formed at the ridge line where the inner peripheral surface of the center hole of the housing intersects the upper surface of the housing.

Preferably, an oil return hole is disposed on the upper surface of the housing, so that the lubricating oil at the friction pair flows to the upper end opening of the oil return pipe via the oil return hole.

Preferably, the generatrix of the inner wall surface of the upright wall is inclined relative to the vertical direction, so that the distance from the lower end of the generatrix to the rotation axis is smaller than the distance from the upper end of the generatrix to the rotation axis.

Technical Effect

The scroll compressor and its lubricating oil supply system provided by the present disclosure have a simple structure, good oil supply effect, and can effectively prevent the wear of the thrust surface when the scroll compressor is operating at a high speed, and thus are suitable for engineering applications.

BRIEF DESCRIPTION OF THE DRAWINGS

In order to facilitate understanding of the present disclosure, the present disclosure is hereinafter described in more detail based on exemplary embodiments in conjunction with the accompanying drawings. The same or similar reference numbers are used in the accompanying drawings to refer to the same or similar components. It should be understood that the accompanying drawings are only schematic and the dimensions and proportions of the components in the accompanying drawings are not necessarily accurate.

DETAILED DESCRIPTION

The present disclosure is hereinafter described in detail with reference to the accompanying drawings.

Figure 1:
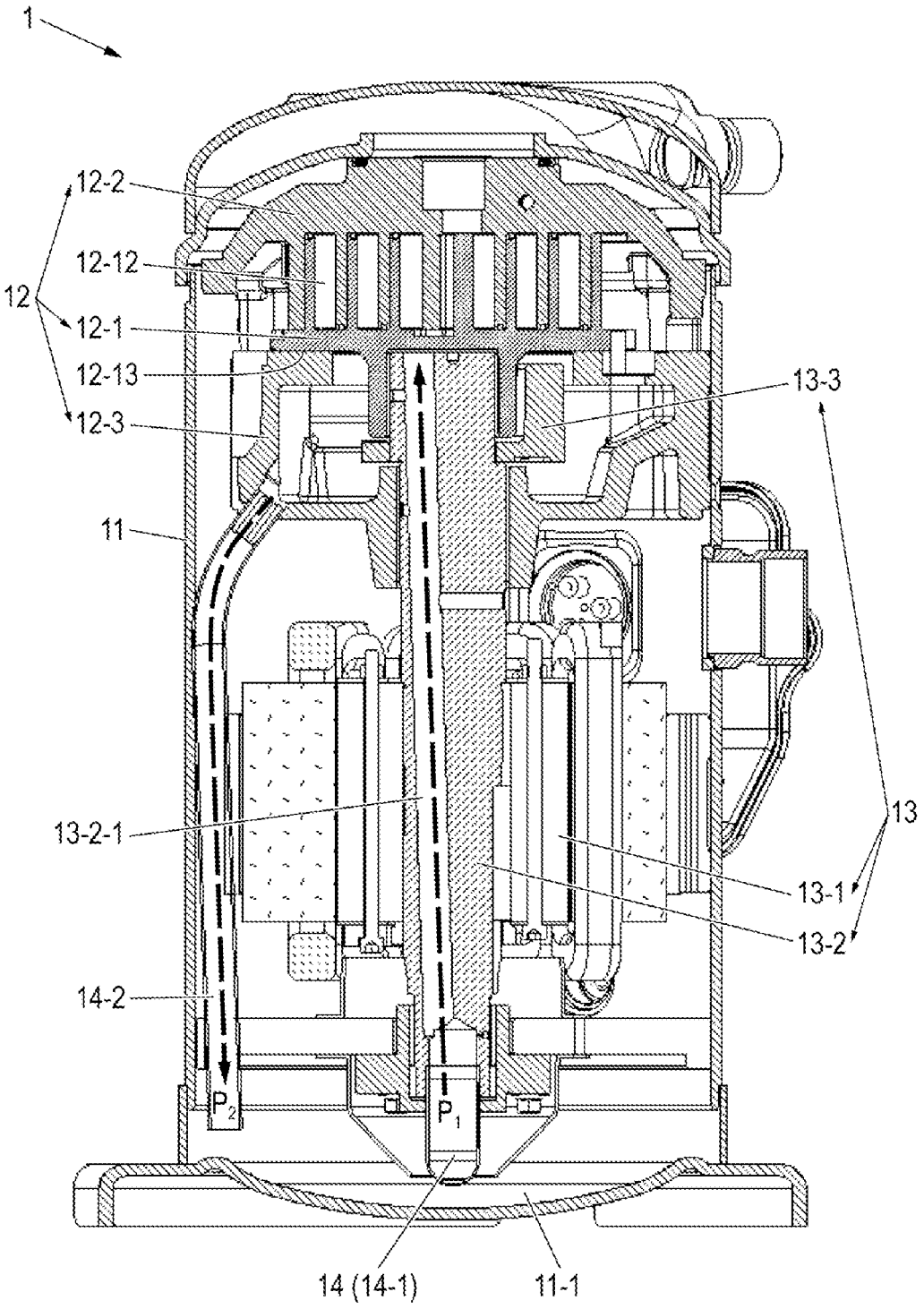
FIG. 1 is a longitudinal cross-sectional view of a scroll compressor according to an exemplary embodiment of the present disclosure.
Figure 2A:
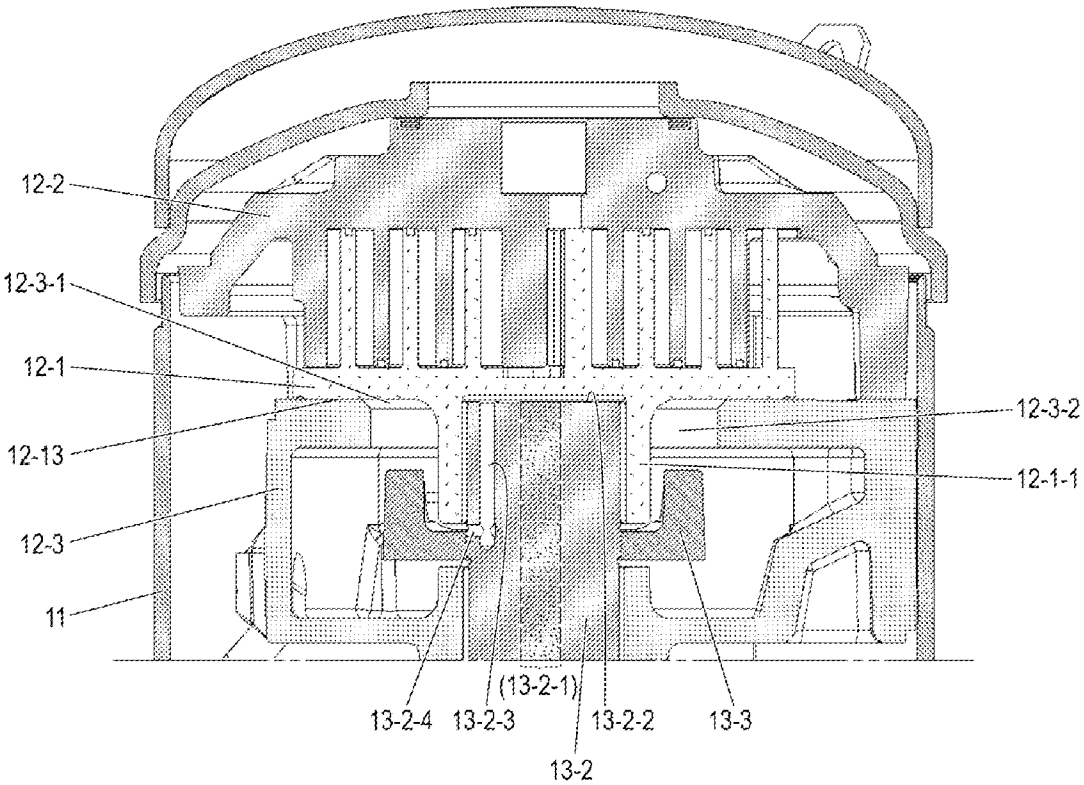
FIG. 2A is a partial longitudinal cross-sectional view of a scroll compressor according to an exemplary embodiment of the present disclosure.
Figure 2B:
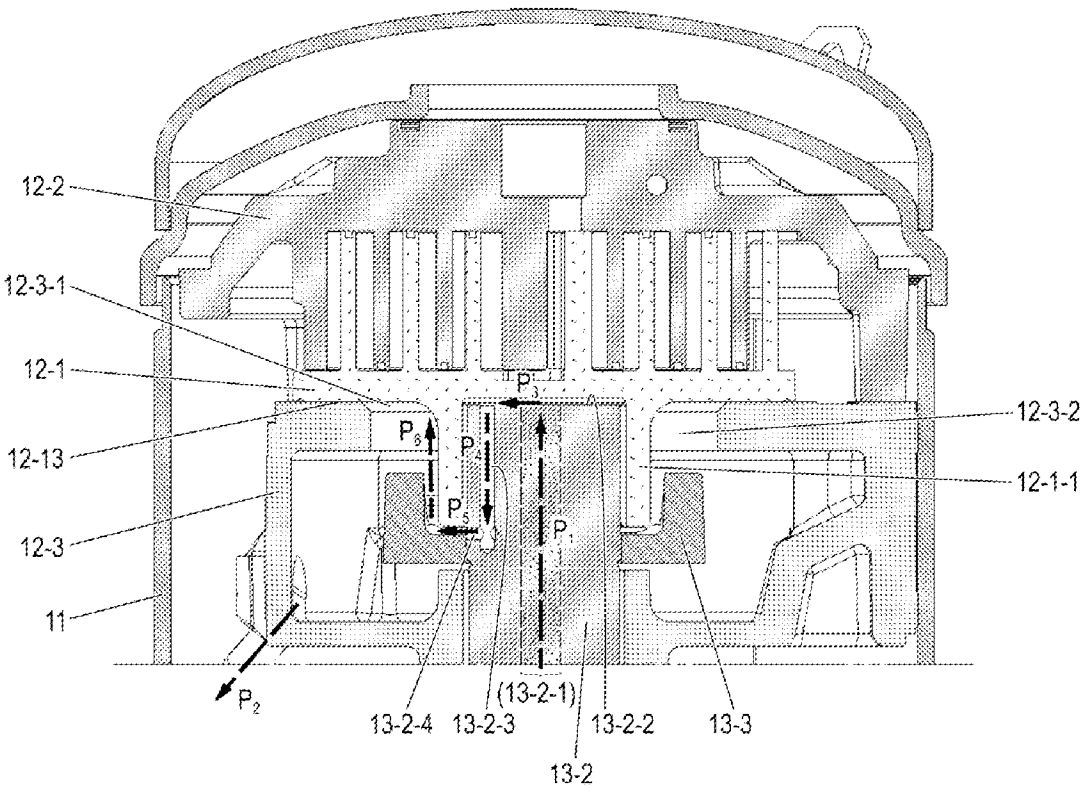
FIG. 2B is a schematic diagram of a lubricating oil flow path of a scroll compressor according to an exemplary embodiment of the present disclosure.

FIG. 1 is a longitudinal cross-sectional view of a scroll compressor according to an exemplary embodiment of the present disclosure. FIG. 2A is a partial longitudinal cross-sectional view of a scroll compressor according to an exemplary embodiment of the present disclosure. FIG. 2B is a schematic diagram of a lubricating oil flow path of a scroll compressor according to an exemplary embodiment of the present disclosure.

As shown in FIG. 1, a scroll compressor 1 according to an exemplary embodiment of the present disclosure comprises a shell 11, a scroll assembly 12 and a drive assembly 13. An oil pool 11-1 for storing lubricating oil is formed at the bottom of the shell 11. The scroll assembly 12 is disposed in the shell 11. The scroll assembly 12 comprises an orbiting scroll 12-1, a fixed scroll 12-2, and a housing 12-3. The fixed scroll 12-2 is fixed in the shell 11. The orbiting scroll 12-1 is disposed below the fixed scroll 12-2 and cooperates with the fixed scroll 12-2 to form a compression chamber 12-12. The housing 12-3 is fixed in the shell 11 and supports the orbiting scroll 12-1 below the orbiting scroll 12-1, thereby forming a friction pair 12-13 between the lower surface of the orbiting scroll 12-1 and the upper surface of the housing 12-3. The drive assembly 13 comprises an electric motor 13-1, a crankshaft 13-2 and an upper counterweight 13-3. The crankshaft 13-2 can be driven by the electric motor 13-1 to rotate. The upper end of the crankshaft 13-2 is cylindrical and inserted into the center hole of the hub 12-1-1 at the bottom of the orbiting scroll 12-1 to drive the orbiting scroll 12-1 to revolve. The upper counterweight 13-3 is disposed at the upper end of the crankshaft 13-2 and rotates with the crankshaft 13-2.

upper end of the crankshaft 13-2 is aligned with the gap between the lower edge of the hub 12-1-1 of the orbiting scroll 12-1 and the upper surface 13-3-2 of the upper counterweight 13-3. The oil passage $P_6$ is formed by the gap between the outer peripheral surface of the hub 12-1-1 of the orbiting scroll 12-1 and the inner wall surface 13-1-2 of the upright wall 13-3-1, and the gap between the outer peripheral surface of the hub 12-1-1 of the orbiting scroll 12-1 and the inner peripheral surface of the center hole 12-3-2 of the housing 12-3. The oil passage $P_2$ is formed by the oil return pipe 14-12. The upper end opening of the oil return pipe 14-12 is located at the bottom of the housing 12-3, and the lower end opening of the oil return pipe 14-12 leads to the oil pool 11-1 to circulate the lubricating oil along the following route:

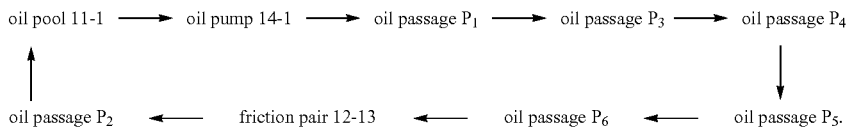

Figure 4:
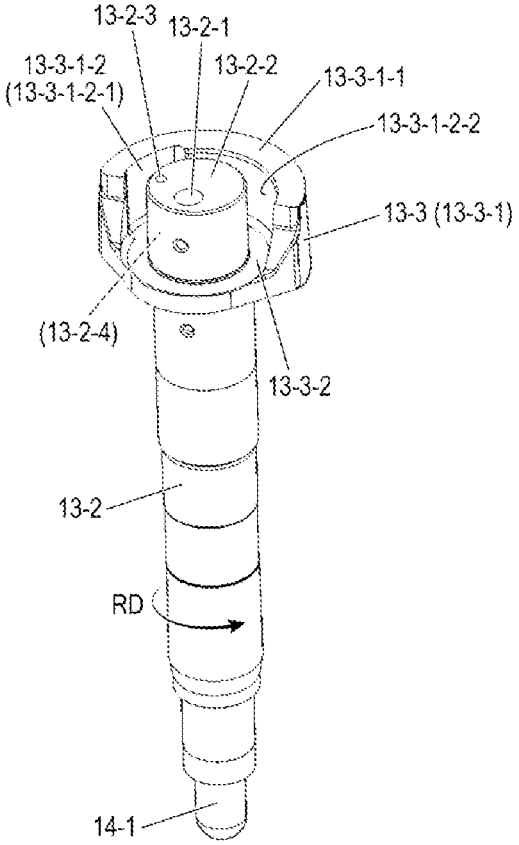
FIG. 4 is a perspective view of an assembly of a crankshaft and an upper counterweight of a scroll compressor according to an exemplary embodiment of the present disclosure.

FIG. 4 is a perspective view of an assembly of a crankshaft 13-2 and an upper counterweight 13-3 of a scroll compressor 1 according to an exemplary embodiment of the present disclosure.

As shown in FIG. 4, the upper counterweight 13-3 has an upper surface 13-3-2 and an upright wall 13-3-1 extending upwards from the upper surface 13-3-22. The upright wall 13-3-1 is a part of a cylindrical body as a whole. The hub 12-1-1 of the orbiting scroll 12-1 is inserted into the gap between the outer peripheral surface of the upper end of the crankshaft 13-2 and the inner wall surface 13-1-2 of the upright wall 13-3-1.

As shown in FIGS. 1 to 2B and FIG. 4, the scroll compressor 1 further comprises a lubricating oil supply system 14. The lubricating oil supply system 14 comprises an oil passage $P_1$, an oil passage $P_2$, an oil passage $P_3$, an oil passage $P_4$, an oil passage $P_5$, an oil passage $P_6$, an oil pump 14-1, and the like. An oil passage $P_1$ is formed by a core hole 13-2-1 extending generally longitudinally through the crankshaft 13-2. Although the oil passage $P_1$ is not actually visible in FIGS. 2A and 2B, the position where the oil passage $P_1$ (i.e., the core hole 13-2-1 of the crankshaft 13-2) is located is shown in dashed lines in FIGS. 2A and 2B for the sake of clarity. The oil pump 14-1 is installed at the lower end of the crankshaft, wherein the oil suction port at the lower end of the oil pump 14-1 is immersed in the lubricating oil in the oil pool 11-1, and the oil outlet of the upper end of the oil pump 14-1 is connected to the oil passage $P_1$. The oil passage $P_3$ is located in the gap between the upper end surface 13-2-2 of the crankshaft 13-2 and the lower surface of the orbiting scroll 12-1. The oil passage $P_4$ is formed by a longitudinal hole 13-2-3 in the crankshaft 13-2. The longitudinal hole 13-2-3 extends downwards from the upper end surface 13-2-2 of the crankshaft 13-2. The oil passage $P_5$ is formed by a transverse hole 13-2-4 in the crankshaft 13-2 and a gap between the lower edge of the hub 12-1-1 of the orbiting scroll 12-1 and the upper surface 13-3-2 of the upper counterweight 13-3. The transverse hole 13-2-4 extends transversely from the outer peripheral surface of the upper end of the crankshaft 13-2 to communicate with the longitudinal hole 13-2-3. The opening of the transverse hole 13-2-4 on the outer peripheral surface of the FIG. 3 is a perspective view of a housing of a scroll compressor according to an exemplary embodiment of the present disclosure.

Figure 3:
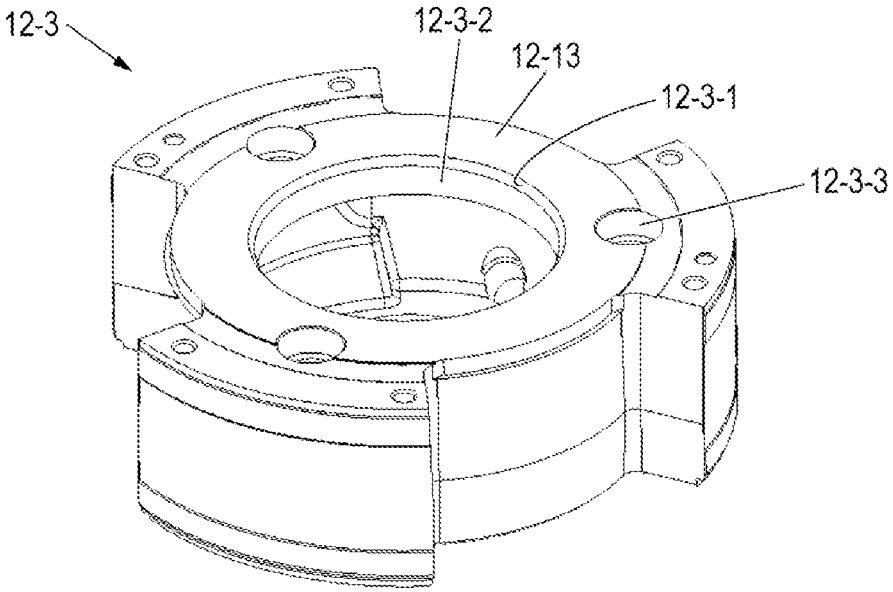
FIG. 3 is a perspective view of a housing of a scroll compressor according to an exemplary embodiment of the present disclosure.

As shown in FIGS. 2A to 3, preferably, a chamfer 12-3-1 is formed at the ridge line where the inner peripheral surface of the center hole 12-3-2 of the housing 12-3 intersects the upper surface of the housing 12-3-1. By forming the chamfer 12-3-1, it helps the lubricating oil flow smoothly along the oil passage $P_6$ to the friction pair 12-13 between the lower surface of the orbiting scroll 12-1 and the upper surface of the housing 12-3, in order to lubricate the thrust surfaces forming the friction pair 12-13. In addition, as shown in FIG. 2B and FIG. 3, preferably, at least one oil return hole 12-3-3 is disposed on the upper surface of the housing 12-3, so that the lubricating oil at the friction pair 12-13 flows towards the upper end opening of the oil return pipe 14-12 via the oil return hole 12-3-3.

Figure 5:
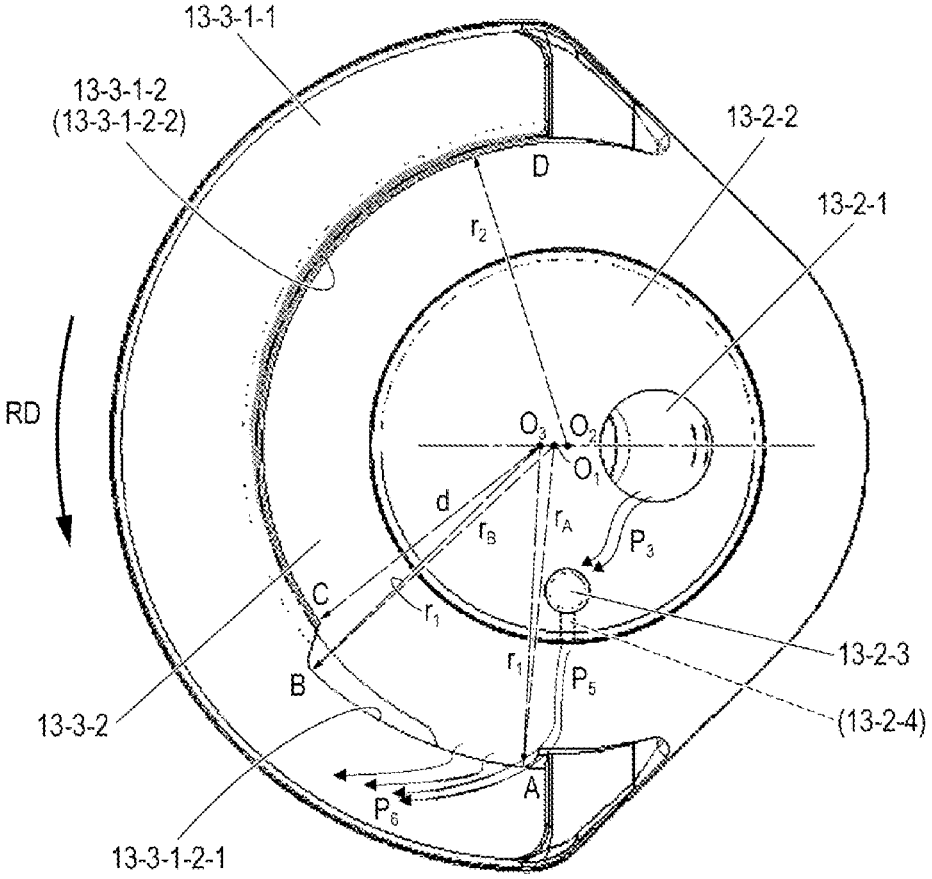
FIG. 5 is a top view of the assembly of the crankshaft and the upper counterweight shown in FIG. 4.

FIG. 5 is a top view of the assembly of the crankshaft 13-2 and the upper counterweight 13-3 shown in FIG. 4.

As shown in FIGS. 4 and 5, the inner wall surface 13-1-2 of the upright wall 13-3-1 comprises a first arc section 13-3-1-2-1 (that is, the arc section $\overset{\frown}{AB}$ in FIG. 5) and a second arc section 13-3-1-2-2 (that is, the arc section $\overset{\frown}{CD}$ in FIG. 5). As shown in FIG. 5, when the driving assembly 13 is viewed from top, the rotation center $O_1$ of the crankshaft 13-2, the circle center $O_2$ of the upper end of the crankshaft 13-2, and the circle center $O_3$ of the first arc section 13-3-1-2-1 are collinear. The circle center $O_2$ of the upper end of the crankshaft 13-2 and the circle center $O_3$ of the first arc section 13-3-1-2-1 are respectively located on opposite sides of the rotation center $O_1$ of the crankshaft 13-2, and the second arc section 13-3-1-2-2 are centered in the circle center $O_2$ of the upper end of the crankshaft 13-2.

By appropriately setting the size of parameters such as the radius $r_2$ of the second arc section 13-3-1-2-2, the following objective can be achieved: when referring to the rotation direction RD of the crankshaft 13-2, the first arc section 13-3-1-2-1 is located on the upstream side of the second arc section 13-3-1-2-2 such that the radius $r_1$ of the first arc section 13-3-1-2-1, the distance $r_A$ from the upstream end A of the first arc section 13-3-1-2-1 to the rotation center $O_1$ of the crankshaft, and the distance $r_B$ from the downstream end B of the first arc section 13-3-1-2-1 to the rotation center $O_1$ of the crankshaft, and the distance d from the upstream end C of the second arc section 13-3-1-2-2 to the circle center $O_3$ of the first arc section 13-3-1-2-1 satisfy the following relationship: $r_1>d$ and $r_B>r_A$. In this way, it can be ensured that the downstream end B of the first arc section 13-3-1-2-1 is radially further outwards than the upstream end C of the second arc section 13-3-1-2-2, thus an oil storage tank is formed by the first arc section 13-3-1-2-1, which in turn facilitates the retention of lubricating oil in the oil storage tank.

In addition, the opening of the transverse hole 13-2-4 on the outer peripheral surface of the upper end of the crankshaft 13-2 is configured to face the upstream end A of the first arc section. Although the transverse hole 13-2-4 is not actually visible in FIG. 5, the position where the transverse hole 13-2-4 is located is shown in dashed lines in FIG. 5 for the sake of clarity. It has been verified by experiments that by adopting such a structure, the lubricating oil can reach the top surface 13-1-1 of the upright wall 13-3-1 of the upper counterweight 13-3 and finally reaches the friction pair 12-13 between the lower surface of the orbiting scroll 12-1 and the upper surface of the housing 12-3 with the inner wall surface 13-1-2 of the upright wall 13-3-1 of the upper counterweight 13-3 and the action of centrifugal force, so as to lubricate the thrust surfaces forming the friction pairs 12-13.

Figure 6:
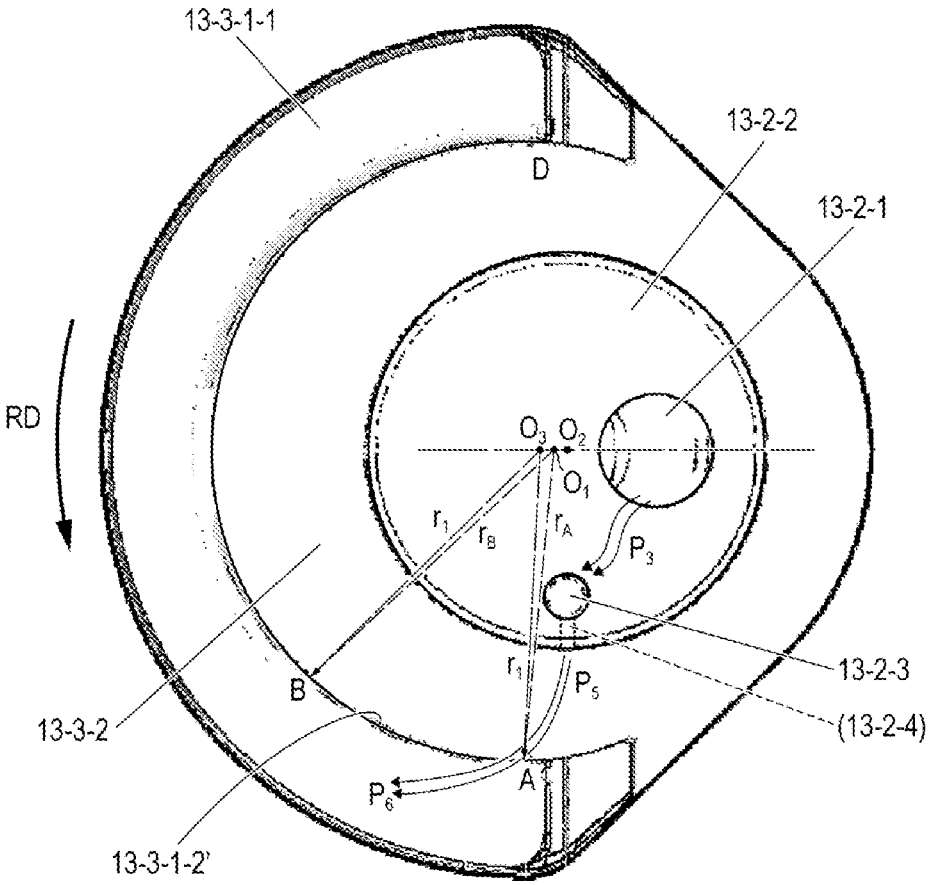
FIG. 6 is a top view of an assembly of a crankshaft and upper counterweight of a scroll compressor according to another exemplary embodiment of the present disclosure.

FIG. 6 is a top view of an assembly of a crankshaft and upper counterweight of a scroll compressor according to another exemplary embodiment of the present disclosure.

As shown in FIG. 6, when the driving assembly 13 is viewed from top, the inner wall surface 13-3-1-2' (i.e., the arc section $\widehat{AB}$ D in FIG. 6) of the upright wall 13-3-1 of the upper counterweight 13-3 is generally semi-arc. The rotation center $O_1$ of the crankshaft 13-2, the circle center $O_2$ of the upper end of the crankshaft 13-2, and the circle center $O_3$ of the inner wall surface 13-3-1-2' are collinear. The circle center $O_2$ of the upper end of the crankshaft 13-2 and the circle center $O_3$ of the inner wall surface 13-3-1-2' are respectively located on opposite sides of the rotation center $O_1$ of the crankshaft 13-2, so that when referring to the rotation direction RD of the crankshaft 13-2, the distance $r_A$ from the upstream end point A of the inner wall surface 13-3-1-2' to the rotation center $O_1$ of the crankshaft 13-2, and the distance $r_B$ from any point B located on the downstream side of the upstream end point A on the inner wall surface 13-3-1-2' to the rotation center $O_1$ of the crankshaft 13-2 satisfy the following relationship: in the range of $\angle AO_1B<90°$, $r_B>r_A$. Further, similarly to the case shown in FIG. 5, the opening of the transverse hole 13-2-4 on the outer peripheral surface of the upper end of the crankshaft 13-2 is configured to face the upstream end point A of the inner wall surface. Also by adopting such a structure, the effect of promoting the smooth flow of lubricating oil to the friction pairs 12-13 can be achieved.

Optionally, in the above-mentioned exemplary embodiment, the generatrix of the inner wall surface 13-3-1-2, 13-3-1-2' of the upright wall 13-3-1 of the upper counterweight 13-3 may be slightly inclined relative to the vertical direction, so that the distance from the lower end of the generatrix to the rotation axis is smaller than the distance from the upper end of the generatrix to the rotation axis, which can increase the smoothness of oil output.

Although the technical object, technical solution and technical effect of the present disclosure have been described in detail above with reference to specific embodiments, it should be understood that the above-mentioned embodiments are only exemplary rather than limiting. Within the essential spirit and principle of the present disclosure, any modifications, equivalent replacements, and improvements made by those skilled in the art are included within the protection scope of the present disclosure.

What is claimed is:

1. A scroll compressor, comprising:

a shell, an oil pool for storing lubricating oil being formed at a bottom of the shell;

a scroll assembly disposed in the shell, and the scroll assembly comprising:

a fixed scroll fixed in the shell, an orbiting scroll disposed below the fixed scroll and cooperating with the fixed scroll to form a compression chamber, and a housing fixed in the shell and supporting the orbiting scroll below the orbiting scroll, thereby forming a friction pair between a lower surface of the orbiting scroll and an upper surface of the housing; and a drive assembly, comprising:

an electric motor, a crankshaft drivable by the electric motor to rotate, an upper end of the crankshaft being cylindrical and inserted into a center hole of a hub at a bottom of the orbiting scroll to drive the orbiting scroll to revolve, and an upper counterweight disposed at the upper end of the crankshaft and rotating with the crankshaft, the upper counterweight having an upper surface and an upright wall extending upwards from the upper surface of the upper counterweight, the upright wall being a part of a cylindrical body, and the hub of the orbiting scroll being inserted into a gap between an outer peripheral surface of the upper end of the crankshaft and an inner wall surface of the upright wall;

wherein, the scroll compressor further comprises a lubricating oil supply system, and the lubricating oil supply system comprises:

an oil passage $P_1$ formed by a core hole extending longitudinally through the crankshaft;

an oil pump installed at a lower end of the crankshaft, wherein an oil suction port at the lower end of the oil pump is immersed in the lubricating oil in the oil pool, and an oil outlet at an upper end of the oil pump is connected to the oil passage $P_1$;

an oil passage $P_3$ located in a gap between an upper end surface of the crankshaft and the lower surface of the orbiting scroll;

an oil passage $P_4$ formed by a longitudinal hole in the crankshaft, the longitudinal hole extending downwards from the upper end surface of the crankshaft;

an oil passage $P_5$ formed by a transverse hole in the crankshaft and a gap between a lower edge of the hub of the orbiting scroll and the upper surface of the upper counterweight, wherein the transverse hole extending transversely from the outer peripheral surface of the upper end of the crankshaft to communicate with the longitudinal hole, an opening of the transverse hole on the outer peripheral surface of the upper end of the crankshaft is aligned with the gap between the lower edge of the hub of the orbiting scroll and the upper surface of the upper counterweight;

an oil passage $P_6$ formed by a gap between an outer peripheral surface of the hub of the orbiting scroll and the inner wall surface of the upright wall, and a gap between the outer peripheral surface of the hub of the orbiting scroll and an inner peripheral surface of a center hole of the housing; and an oil passage $P_2$ formed by an oil return pipe, an upper end opening of the oil return pipe being located at a bottom of the housing, and a lower end opening of the oil return pipe leading to the oil pool to circulate the lubricating oil along the following route:

from the oil pool to the oil pump, then to the oil passage $P_1$, then to the oil passage $P_3$, then to the oil passage $P_4$, then to the oil passage $P_5$, then to the oil passage $P_6$, then to the friction pair, then to the oil passage $P_2$, and then returning to the oil pool.

2. The scroll compressor according to claim 1, wherein, the inner wall surface of the upright wall comprises a first arc section and a second arc section, when the drive assembly is viewed from top, a rotation center ($O_1$) of the crankshaft, a circle center ($O_2$) of the upper end of the crankshaft and a circle center ($O_3$) of the first arc section are collinear, and the circle center ($O_2$) of the upper end of the crankshaft and the circle center ($O_3$) of the first arc section are respectively located on opposite sides of the rotation center ($O_1$) of the crankshaft, and the second arc section are centered in the circle center ($O_2$) of the upper end of the crankshaft, when referring to a rotation direction (RD) of the crankshaft, the first arc section is located on an upstream side of the second arc section such that a radius $r_1$ of the first arc section, a distance $r_A$ from an upstream end (A) of the first arc section to the rotation center ($O_1$) of the crankshaft, a distance $r_B$ from a downstream end (B) of the first arc section to the rotation center ($O_1$) of the crankshaft, and a distance d from an upstream end (C) of the second arc section to the circle center ($O_3$) of the first arc section satisfy the following relationship: $r_1>d$, and $r_B>r_A$, and the opening of the transverse hole on the outer peripheral surface of the upper end of the crankshaft is configured to face the upstream end (A) of the first arc section.

3. The scroll compressor according to claim 2, wherein, a generatrix of the inner wall surface of the upright wall is inclined relative to a vertical direction, so that a distance from a lower end of the generatrix to a rotation axis is smaller than a distance from an upper end of the generatrix to the rotation axis.

4. The scroll compressor according to claim 1, wherein, when the drive assembly is viewed from top, the inner wall surface of the upright wall is semi-arc; a rotation center ($O_1$) of the crankshaft, the circle center ($O_2$) of the upper end of the crankshaft and the circle center ($O_3$) of the inner wall surface are collinear, and the circle center ($O_2$) of the upper end of the crankshaft and the circle center ($O_3$) of the inner wall surface are respectively located on opposite sides of the rotation center ($O_1$) of the crankshaft, so that when referring to a rotation direction (RD) of the crankshaft, a distance $r_A$ from an upstream end point A of the inner wall surface to the rotation center ($O_1$) of the crankshaft, and a distance $r_B$ from any point B located on a downstream side of the upstream end point A on the inner wall surface to the rotation center ($O_1$) of the crankshaft satisfy the following relationship: in a range of $\angle AO_1B<90°$, $r_B>r_A$, and the opening of the transverse hole on the outer peripheral surface of the upper end of the crankshaft is configured to face the upstream end point A of the inner wall surface.

5. The scroll compressor according to claim 4, wherein, a generatrix of the inner wall surface of the upright wall is inclined relative to a vertical direction, so that a distance from a lower end of the generatrix to a rotation axis is smaller than a distance from an upper end of the generatrix to the rotation axis.

6. The scroll compressor according to claim 1, wherein, a chamfer is formed at a ridge line where the inner peripheral surface of the center hole of the housing intersects the upper surface of the housing.

7. The scroll compressor according to claim 6, wherein, a generatrix of the inner wall surface of the upright wall is inclined relative to a vertical direction, so that a distance from a lower end of the generatrix to a rotation axis is smaller than a distance from an upper end of the generatrix to the rotation axis.

8. The scroll compressor according to claim 1, wherein, an oil return hole is disposed on the upper surface of the housing, so that the lubricating oil at the friction pair flows to the upper end opening of the oil return pipe via the oil return hole.

9. The scroll compressor according to claim 8, wherein, a generatrix of the inner wall surface of the upright wall is inclined relative to a vertical direction, so that a distance from a lower end of the generatrix to a rotation axis is smaller than a distance from an upper end of the generatrix to the rotation axis.

10. The scroll compressor according to claim 1, wherein, a generatrix of the inner wall surface of the upright wall is inclined relative to a vertical direction, so that a distance from a lower end of the generatrix to a rotation axis is smaller than a distance from an upper end of the generatrix to the rotation axis.

* * * * *